US010435205B1

(12) United States Patent
Tubbs

(10) Patent No.: US 10,435,205 B1
(45) Date of Patent: Oct. 8, 2019

(54) PAINT BUCKET LID

(71) Applicant: Shawn Tubbs, Erie, PA (US)

(72) Inventor: Shawn Tubbs, Erie, PA (US)

( * ) Notice: Subject to any disclaimer, the term of this patent is extended or adjusted under 35 U.S.C. 154(b) by 0 days.

(21) Appl. No.: 16/189,600

(22) Filed: Nov. 13, 2018

(51) Int. Cl.

| | |
|---|---|
| ***B65D 43/26*** | (2006.01) |
| ***B65D 47/08*** | (2006.01) |
| ***B44D 3/12*** | (2006.01) |
| ***B65D 43/02*** | (2006.01) |

(52) U.S. Cl.
CPC ..... *B65D 47/0847* (2013.01); *B44D 3/127* (2013.01); *B65D 43/0212* (2013.01); *B65D 43/26* (2013.01); *B65D 2547/06* (2013.01)

(58) Field of Classification Search
CPC ..... B65D 47/0847; B65D 47/06; B65D 43/0212; B65D 2547/06
USPC ..... 220/810, 254.3
See application file for complete search history.

(56) References Cited

U.S. PATENT DOCUMENTS

| | | | | |
|---|---|---|---|---|
| 1,470,199 | A * | 10/1923 | Small | A47J 27/13 131/242 |
| 3,421,654 | A | 1/1969 | Hexel | |
| 5,452,820 | A | 9/1995 | Mislavsky | |
| D467,049 | S | 12/2002 | Kohn | |
| D467,398 | S | 12/2002 | Kohn | |
| 2014/0102925 | A1* | 4/2014 | Jacobson | B25H 3/00 206/361 |

* cited by examiner

*Primary Examiner* — King M Chu
(74) *Attorney, Agent, or Firm* — Richard K Thomson

(57) ABSTRACT

A paint bucket lid is provided which easily is fitted atop a 5 gallon paint bucket. The lid has an access aperture which readily receives a siphon hose to supply paint to line painting equipment. A flap is hingedly connected to a fixed portion of the lid allowing it to be opened exposing an opening through which additional paint may be added without interrupting the line painting operation.

2 Claims, 2 Drawing Sheets

PAINT BUCKET LID

This application claims the benefit of provisional Pat. Appl. Ser. No. 62/684,715 filed Jun. 18, 2018.

BACKGROUND AND SUMMARY OF THE INVENTION

The present invention is directed to improving the utilization of a 5 gallon bucket, or the like, as a source for painting lines on surfaces such as pavement. Currently, the siphon hose must be removed from the empty bucket and the lid removed so additional paint can be added to the supply bucket, or alternatively, the lid with the siphon hose moved to a new, full supply bucket. This is a messy and time consuming process. Meanwhile, the stripe application process is interrupted and things are brought to a standstill.

In the present invention, a lid with a flap that makes pouring paint into bucket simple. The lid will fit snugly over the top of any standard 5 gallon paint bucket. It will have a hinged flap, approximately half the size of the overall diameter of the lid. The handle for the flap will be able to fold down when not in use. This will permit the lids to be readily stacked on a shelf for marketing. The purpose of this invention is to make refilling a five gallon paint bucket simple and help keep the syphon hose in the paint while refilling the paint bucket cutting down on the messiness and the downtime.

Various other features, advantages, and characteristics of the present invention will become apparent after a reading of the following detailed description.

DETAILED DESCRIPTION OF THE PREFERRED EMBODIMENT(S)

A first embodiment of the of the present invention is depicted in the accompanying figures, like reference numerals depicting like elements:

Figure 1:
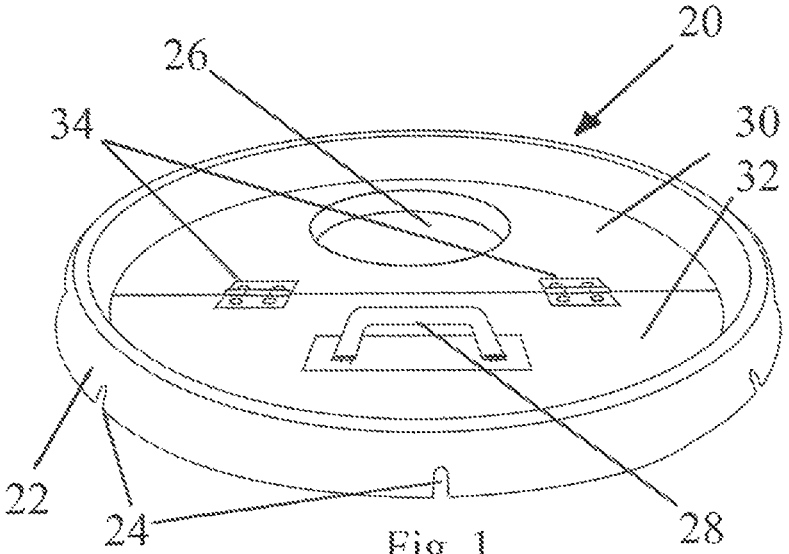
FIG. 1 is a front perspective view of the first embodiment of the paint can lid of the present invention.
Figure 2:
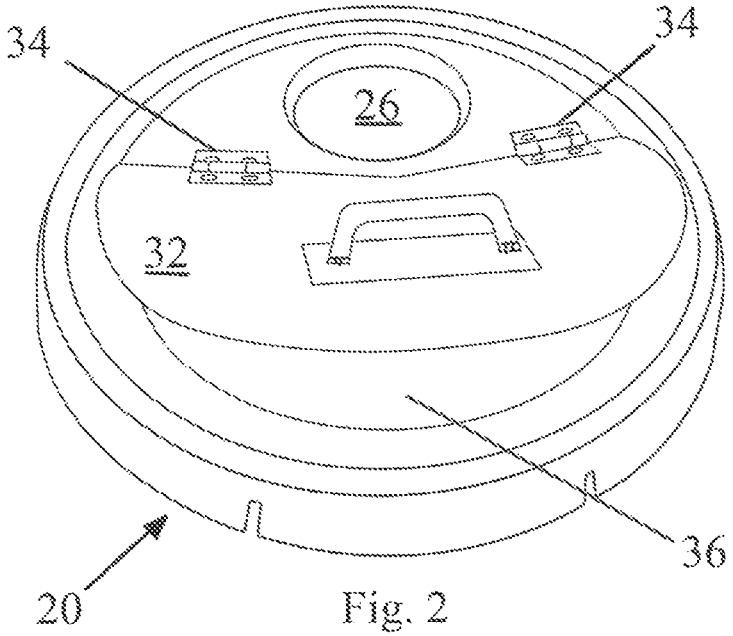
FIG. 2 is a front perspective view of the paint can lid of the present invention with the flap ajar; and, FIG. 3 is a front perspective view of the paint can lid of the present invention mounted on a 5 gallon bucket.
Figure 3:
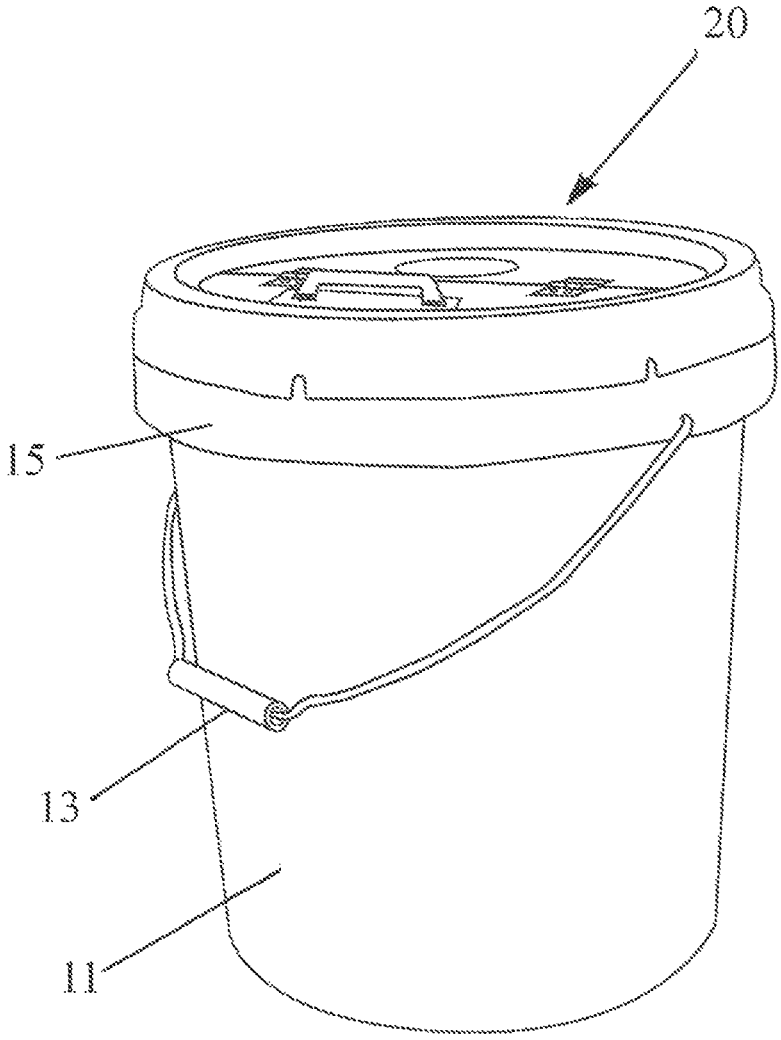

A first embodiment of the paint bucket lid of the present invention is depicted in FIGS. 1-3 generally at 20. Paint bucket lid 20 has a downwardly protruding flange 22 having a plurality of slots 24 positioned about the periphery to provide flexibility in the flange 22 whereby the flange 22 may grip a top flange 15 of bucket 11 (FIG. 3). Opening 26 in fixed portion 30 of the top of paint bucket lid 20 provides access for a flex hose siphon tube (not shown) which draws paint from bucket 11 for transmission to line painting equipment. Flap 32 is attached to fixed portion 30 by two hinges 34 which permits handle 28 to be grasped and flap 32 to be opened exposing opening 36 through which additional paint may be added without the need to stop the painting equipment nor transfer lid 22 to a second bucket 11. This reduces spillage of paint and minimizes/eliminates downtime as the painting operation may continue unabated as additional paint supply is poured through opening 36. Preferably, handle 28 is hinged to flap 32 allowing handle 28 to folded flat atop flap 32 so that a plurality of lids 20 can be stacked for merchandising. The typical paint bucket 11 is equipped with a handle 13 to facilitate its transport.

Various changes, alternatives, and modifications will become apparent to a person of ordinary skill in the art after a reading of the foregoing specification. It is intended that all such changes, alternatives, and modifications be considered part of the present invention.

I claim:

1. A lid for a five gallon paint bucket, said lid comprising:

a) securing means for removably attaching said lid to an upper rim of the bucket;

b) an access aperture extending through a portion of said lid configured to perform a function of allowing insertion of a siphon hose into the bucket;

c) a first fixed body portion of said lid through which said access aperture extends;

d) a flap having a hinge which hingedly attaches said flap to said first fixed body portion configured to perform an allowing of paint being added to the paint bucket, whereby said flap may be opened by folding said flap upon said hinge onto said first body portion allowing additional paint to be added to the bucket while the siphon hose continues to function during a line painting operation.

2. The lid of claim 1 further comprising a handle and a hinge configured to perform hinging of said handle to said flap whereby said handle may be folded flat atop said flap facilitating stacking of a plurality of said lids.

* * * * *